US008052229B2

(12) United States Patent
Yu et al.

(10) Patent No.: US 8,052,229 B2
(45) Date of Patent: Nov. 8, 2011

(54) INTERLOCKING MECHANISM FOR SLIDING RAILS

(75) Inventors: Mo-Ming Yu, Shenzhen (CN); Xiang-Wei He, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 724 days.

(21) Appl. No.: 12/182,116

(22) Filed: Jul. 29, 2008

(65) Prior Publication Data

US 2009/0289533 A1 Nov. 26, 2009

(30) Foreign Application Priority Data

May 21, 2008 (CN) ..... 2008 1 0301701

(51) Int. Cl.
*E05B 65/46* (2006.01)

(52) U.S. Cl. ..... 312/221

(58) Field of Classification Search ..... 312/107.5, 312/216, 217, 219, 220, 221, 902, 319.1; 70/78, 85

See application file for complete search history.

(56) References Cited

U.S. PATENT DOCUMENTS

| | | | | | |
|---|---|---|---|---|---|
| 788,966 | A * | 5/1905 | Upton | 312/107.5 |
| 1,603,483 | A * | 10/1926 | Masengale | 312/221 |
| 1,613,731 | A * | 1/1927 | Stockov | 312/221 |
| 3,259,444 | A * | 7/1966 | Friend | 312/221 |
| 3,323,849 | A * | 6/1967 | Stark | 312/221 |
| 3,874,755 | A * | 4/1975 | Hegg et al. | 312/221 |
| 6,722,167 | B1 * | 4/2004 | Hsu | 70/78 |
| 6,749,274 | B2 * | 6/2004 | Westwinkel | 312/221 |
| 6,896,342 | B1 * | 5/2005 | Cheng | 312/221 |
| 7,264,319 | B2 * | 9/2007 | Cheng | 312/220 |
| 7,540,573 | B2 * | 6/2009 | Lin | 312/221 |

* cited by examiner

*Primary Examiner* — James O Hansen
(74) *Attorney, Agent, or Firm* — Altis Law Group, Inc.

(57) ABSTRACT

An interlocking mechanism is provided for sliding rails mounted to a cabinet. Each sliding rail comprises an outer rail and an inner rail slidably attached to the outer rail. The interlocking mechanism includes a plurality of interlocking members each of which includes a driving portion and a retaining opening. The interlocking members are respectively attached to the sliding rails. A rod is resiliently and slidably attached to the cabinet. The rod includes a plurality of protrusions and a plurality of corresponding resilient members slantingly attached adjacent to one of the protrusions, corresponding to each interlocking member. The retaining opening comprises a guiding part and a retaining part. If one of the interlocking members moves, the resilient members corresponding to the other interlocking members can move to the corresponding retaining opening retaining parts to lock these interlocking members to prevent the corresponding sliding rails from sliding.

17 Claims, 12 Drawing Sheets

INTERLOCKING MECHANISM FOR SLIDING RAILS

BACKGROUND

1. Field of the Invention

The present invention relates to an interlocking mechanism for sliding rails, and more particularly to an interlocking mechanism disposed in a cabinet to interlock sliding rails.

2. Description of Related Art

Generally, servers are movably disposed in a cabinet on sliding rails and arranged vertically. The servers can be pushed into or pulled out of the cabinet easily. However, if several servers in the cabinet are pulled out, the center of gravity of the cabinet might shift, which may result in the cabinet tipping over.

What is needed, therefore, is an interlocking mechanism to prevent several servers of the cabinet from being pulled out.

DETAILED DESCRIPTION

Figure 1:
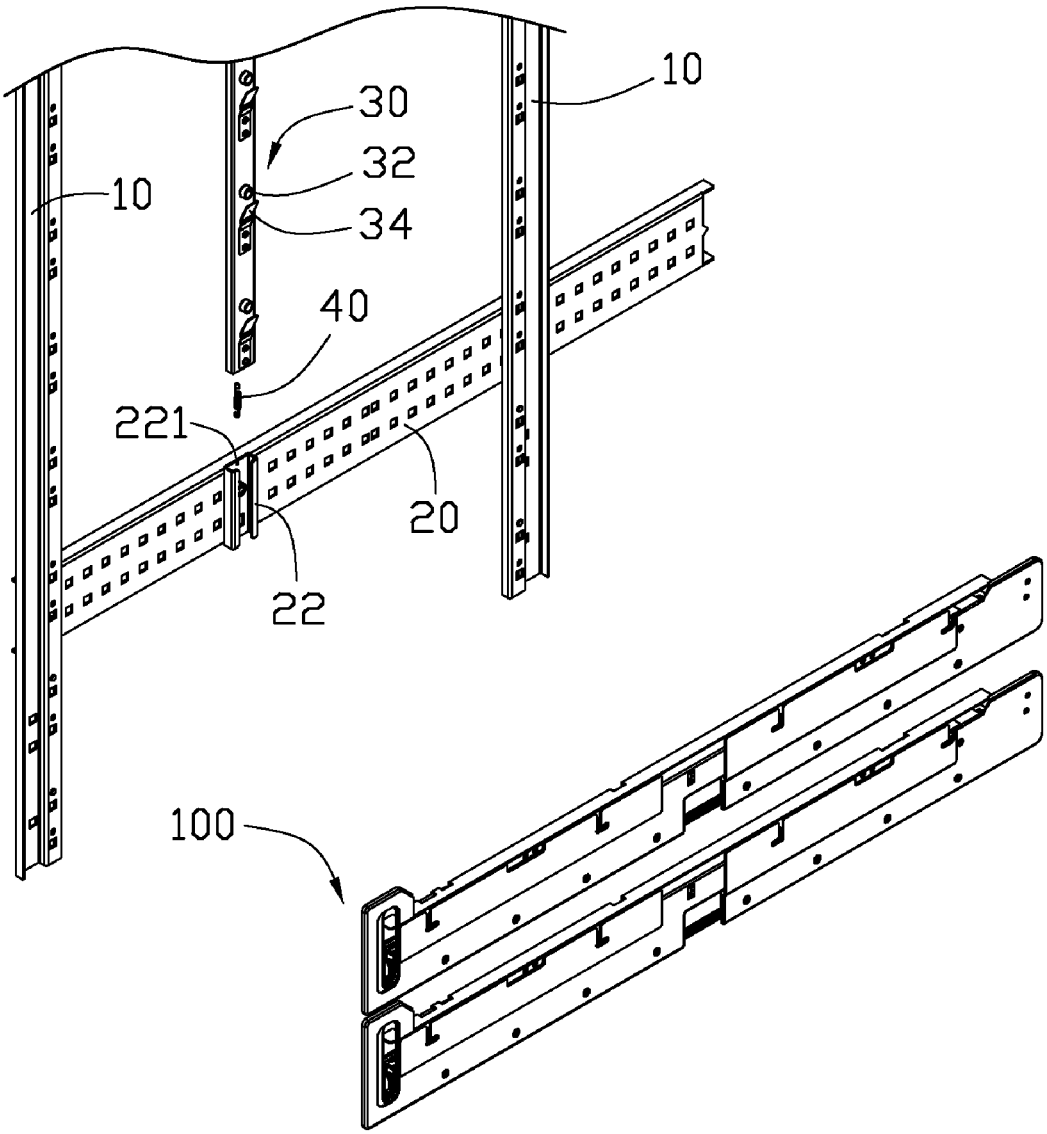
FIG. 1 is an exploded, isometric view of an interlocking mechanism for sliding rails in accordance with an embodiment of the present invention together with a rack of a cabinet, the interlocking mechanism includes a rod, and a plurality of locking subassemblies.
Figure 2:
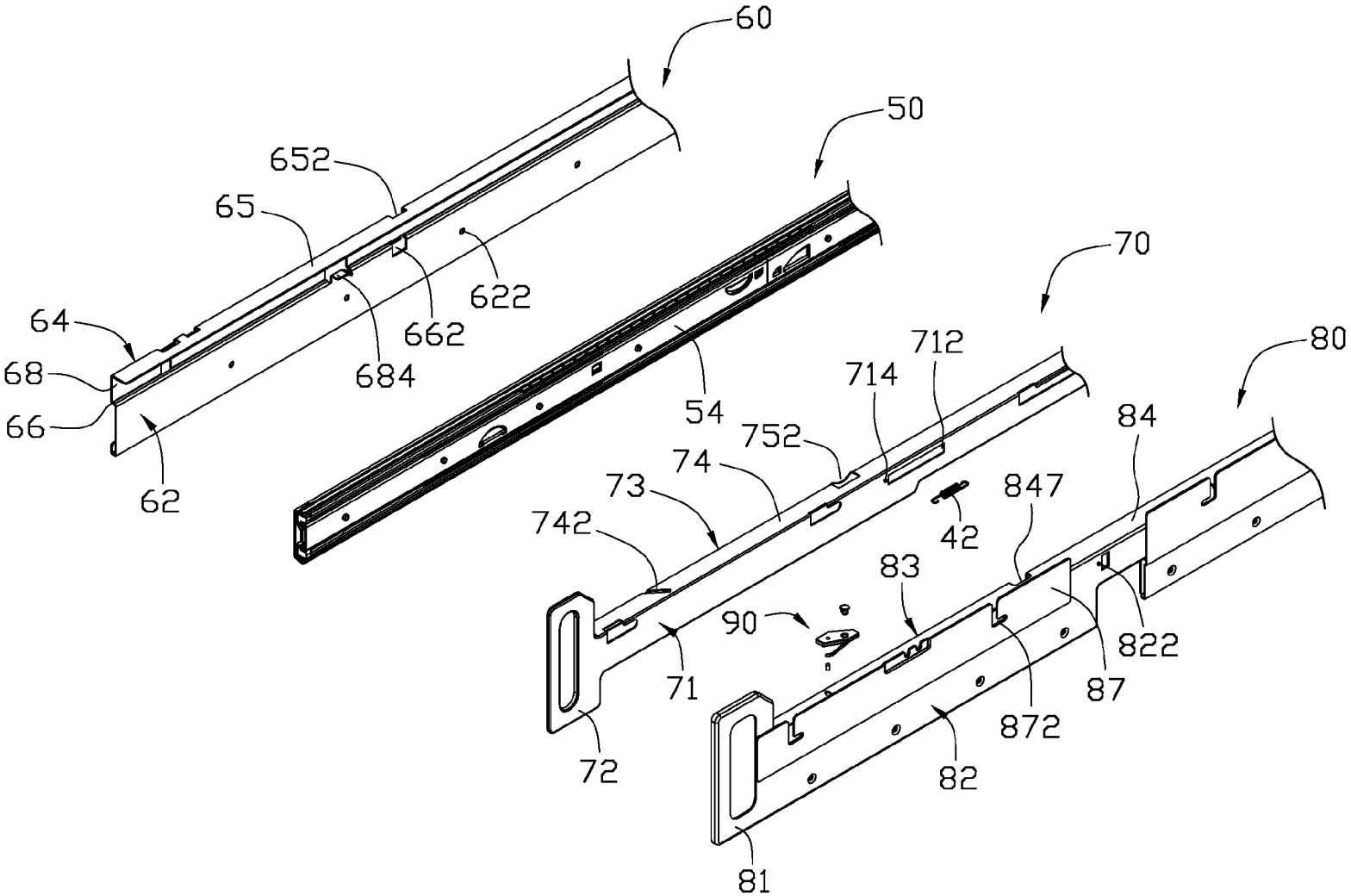
FIG. 2 is an exploded, isometric view of one of the locking subassemblies of FIG. 1 together with a sliding rail, the locking subassembly includes an interlocking member.
Figure 3:
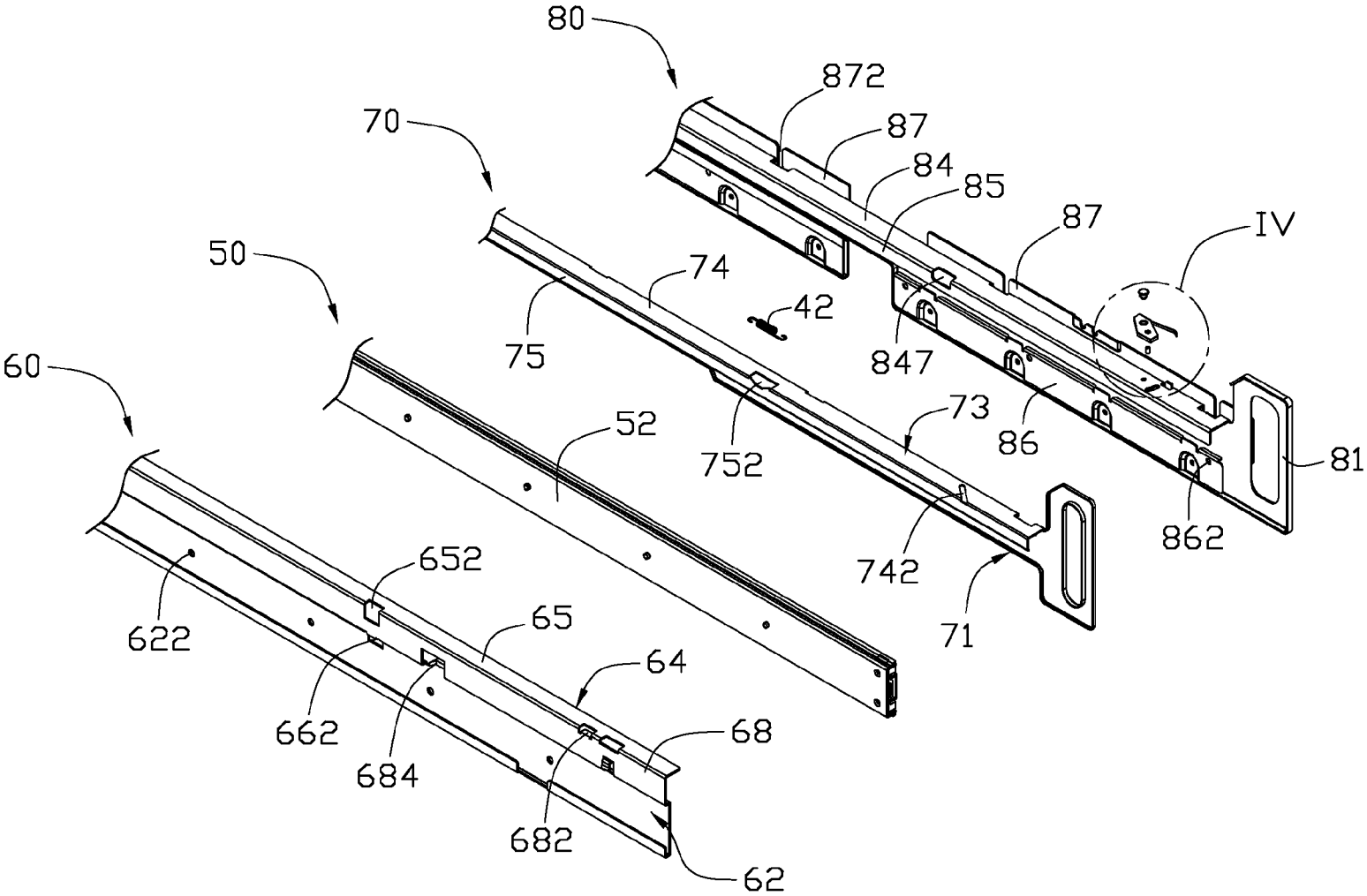
FIG. 3 is similar to FIG. 2, but viewed from another aspect.

Referring to FIGS. 1 to 3, an interlocking mechanism for sliding rails in accordance with an embodiment of the present invention is disposed in a cabinet. The interlocking mechanism includes a rod 30, a first elastic member 40, and a plurality of locking subassemblies 100. The locking subassembly 100 includes a retaining member 60, an interlocking member 70, a locking member 80, a second elastic member 42, and a blocking member 90. In this embodiment the first elastic member 40 and the second elastic member 42 are helical springs. Each locking subassembly 100 is attached to a sliding rail 50.

The cabinet includes two columns 10, and a beam 20 perpendicularly attached to the columns 10. A receiving portion 22 is attached to the middle part of the beam 20. The cross section of the receiving portion 22 is C-shaped. The receiving portion 22 defines a hook hole 221 at the upside thereof.

The cross section of the rod 30 is C-shaped. The rod 30 includes a plurality of protrusions 32 and resilient members 34. The resilient members 34 are arranged along the length of the rod 30. Each protrusion 32 extends from the rod 30 adjacent a free end of a corresponding resilient member 34. The resilient members 34 slantingly extend from the rod 30. Each resilient member 34 and the corresponding protrusion 32 can lock a locking subassembly 100 in position preventing a corresponding server mounted to a corresponding sliding rail 50 from being drawn out of the cabinet. A side opposite to the protrusions 32 of the rod 30 has a hook portion 36 defining a hole therein to receive one end of the first elastic member 40 (see FIGS. 9 and 10).

Each sliding rail 50 includes an outer rail 52 and an inner rail 54 slidably mounted to the outer rail 52. The outer rail 52 and the inner rail 54 respectively define a plurality of screw holes.

The retaining member 60 includes a fixing portion 62 and a retaining portion 64 extending from the top of the fixing portion 62. The fixing portion 62 defines a plurality of fixing holes 622. The retaining portion 64 includes a bottom side 66 perpendicularly extending from the top of the fixing portion 62, a top side 65 parallel to the bottom side 66, and a vertical side 68 vertically connecting the corresponding edges of the top side 65 and the bottom side 66. A junction of the top side 66 and the vertical side 68 defines a first hole 652. A junction of the bottom side 66 and the fixing portion 62 defines a second hole 662. A blocking tab 682 extends inwards from an end of the vertical side 68, adjacent the top side 65. A supporting tab 684 extends inwards from the vertical side 68 adjacent the bottom side 66 and the first hole 652.

Figure 5:
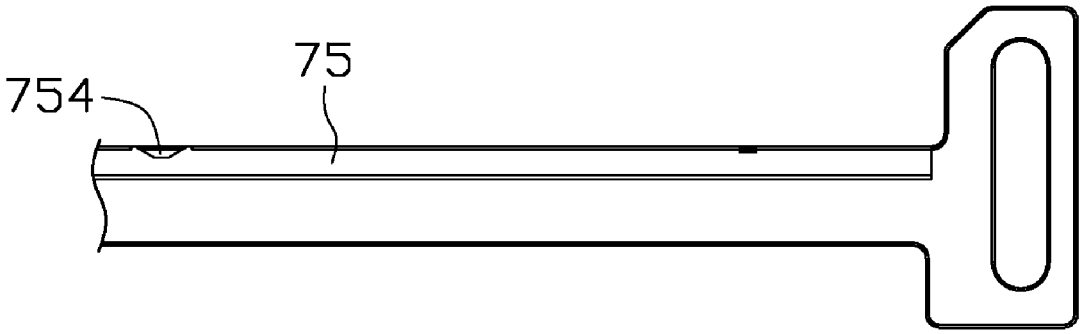
FIG. 5 is a partial front elevational view of the interlocking member of FIG. 3.
Figure 6:
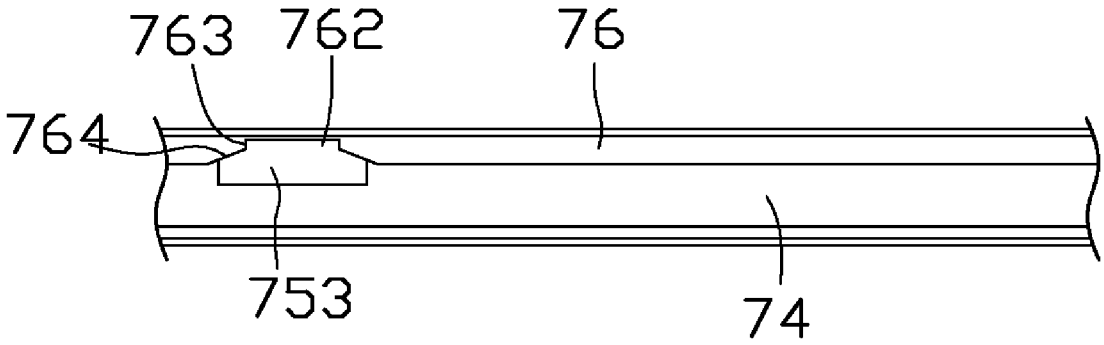
FIG. 6 is a partial bottom plan view of the interlocking member of FIG. 3.
Figure 7:
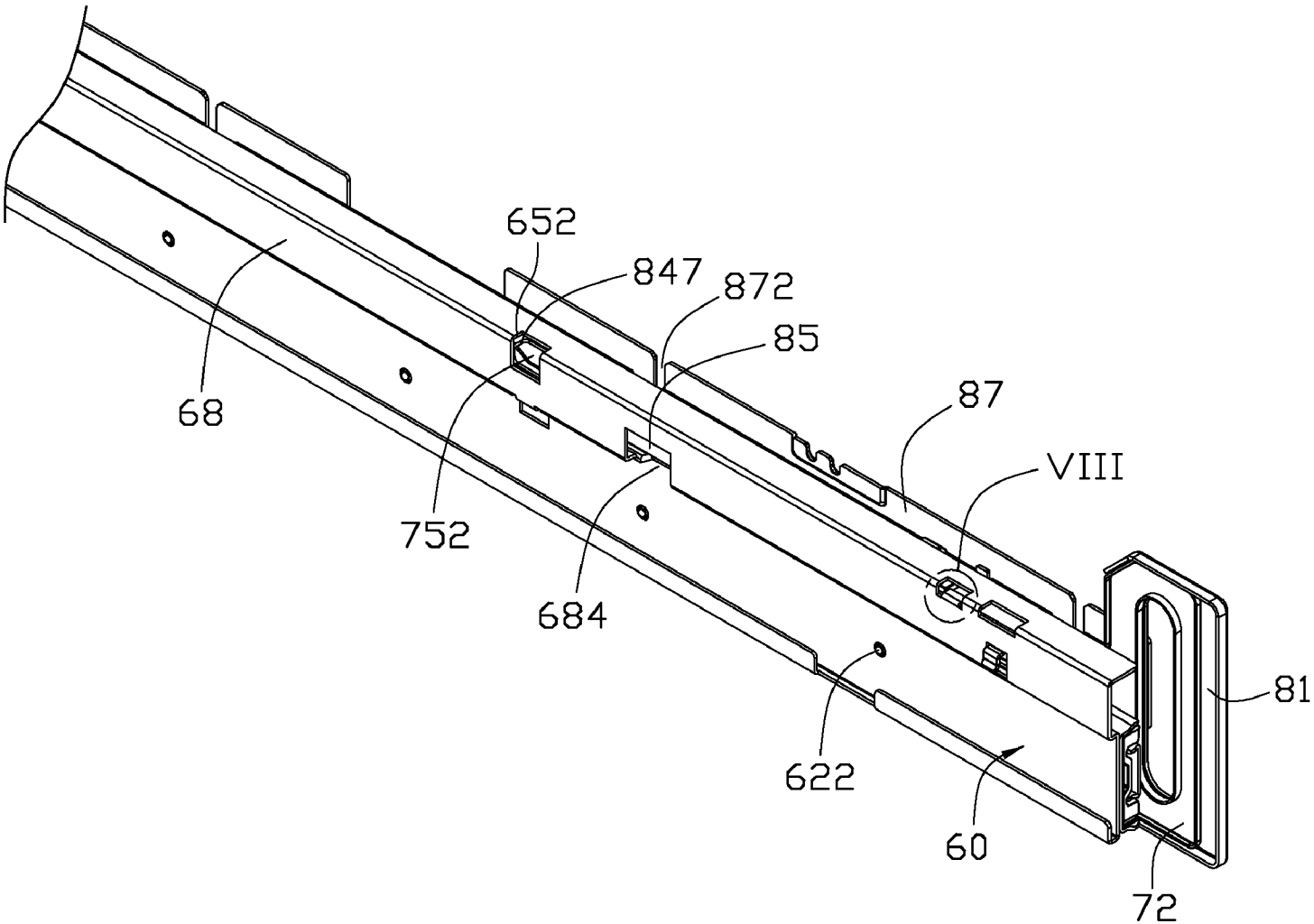
FIG. 7 is an assembled, isometric view of FIG. 3.
Figure 8:
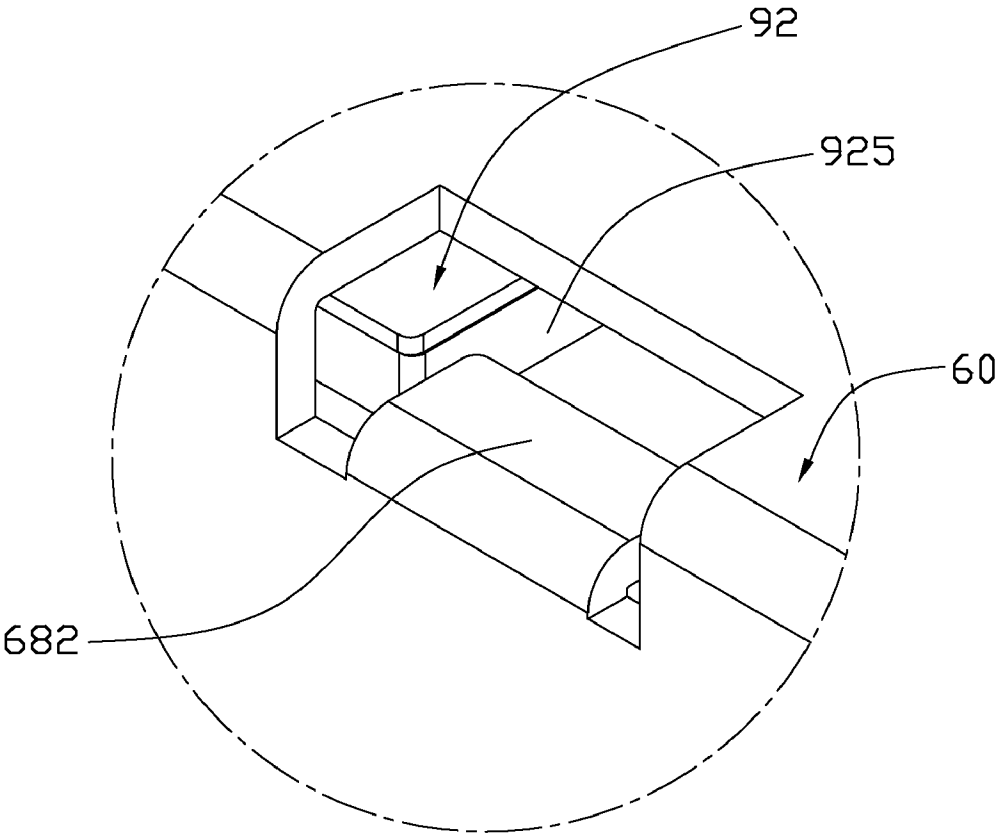
FIG. 8 is an enlarged view of an encircled portion VIII of FIG. 7.

Referring also to FIGS. 5 and 6, the interlocking member 70 includes a body 71, a grip 72 extends from an end of the body 71, and an interlocking portion 73 extending from a top of the body 71. The interlocking portion 73 includes a top side 74 perpendicularly extending from the top of the body 71, a vertical side 75 perpendicularly extending down from a side of the top side 74, and a bottom side 76 perpendicularly extending inwards from the vertical side 75. The top side 74 defines a slanting slot 742. A junction of the top side 74 and the vertical side 75 defines a driving portion 752 in the middle part. The driving portion 752 includes a rectangle-shaped receiving part 753 defined in the top side 74, and a trapezoid-shaped guiding part 754 defined in the vertical side 75. The body 71 defines a rectangle-shaped receiving hole 712 adjacent the driving portion 752 in the middle part thereof, and a hook hole 714 adjacent a side of the receiving hole 712. The bottom side 76 defines a trumpet-shaped retaining opening 762 corresponding to the driving portion 752. The retaining opening 762 includes a trapezoid-shaped guiding part 764 in the distal edge of the bottom side 76, and a rectangle-shaped retaining part 763 adjacent the vertical side 75.

Figure 4:
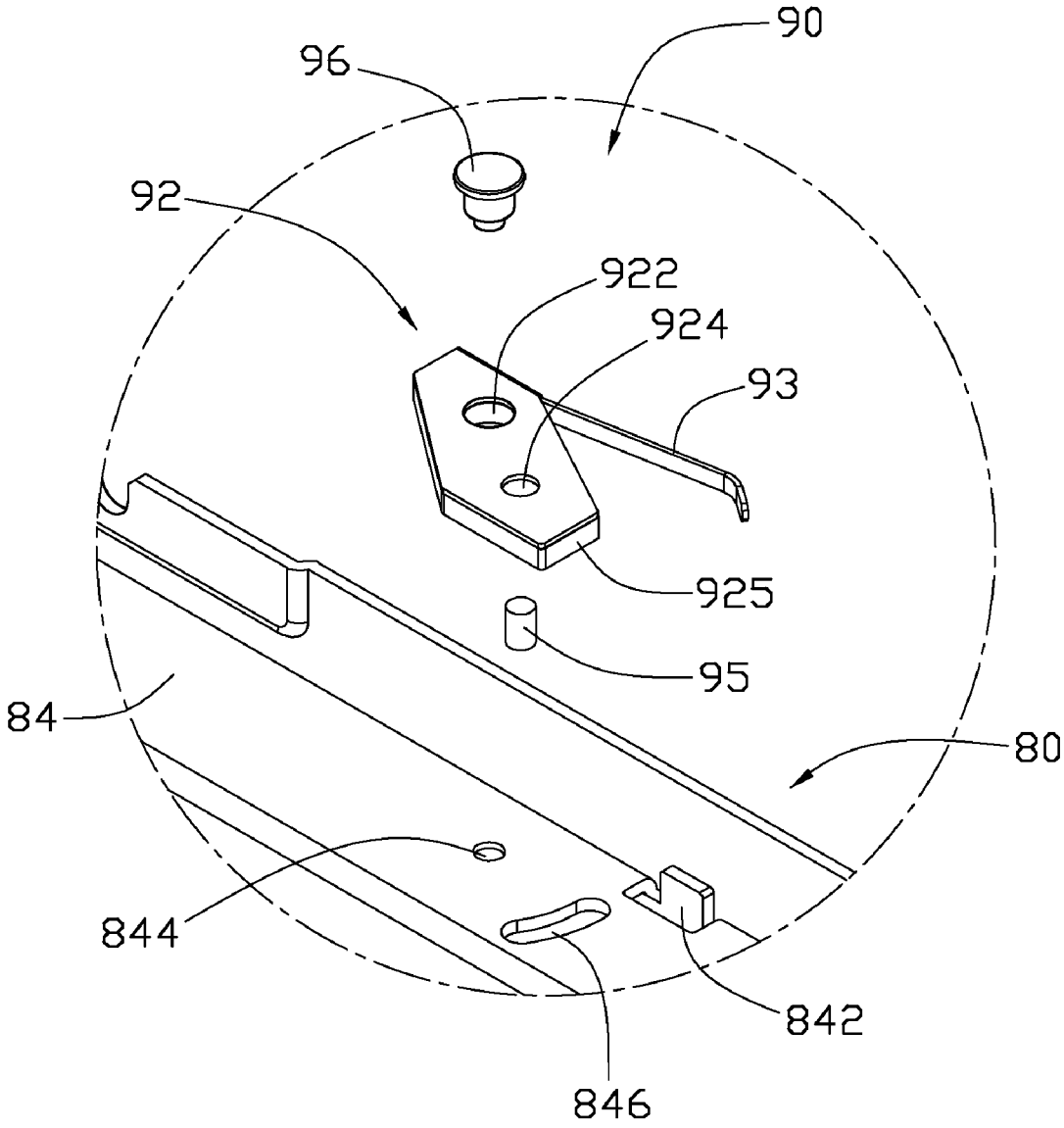
FIG. 4 is an enlarged view of an encircled portion IV of FIG. 3.

Referring also to FIGS. 2 to 4, the locking member 80 includes a body 82 and a grip 81 extends from an end of the body 82. The grip 81 defines a depressed portion in a side facing the interlocking member 70. An L-shaped locking portion 83 extends from an upper portion of the body 82. Two supporting portions 86 spaced from each other are attached to the body 82 below the locking portion 83. Each supporting portion 86 defines a plurality of fixing holes 862. Two retaining portions 87 spaced from each other extend up from the body 82. The body 82 defines a hook hole 822 between the retaining portions 87. The locking portion 83 includes a top side 84 perpendicularly extending from the body 82, and a vertical side 85 vertically extending down from an edge opposite to the body 82 of the top side 84. A protrusion 842 protrudes up from a junction of the body 82 and the top side 84, adjacent the grip 81. The top side 84 defines a peg hole 844 adjacent the protrusion 842, and a nearby arc-shaped slot 846 having a same center point as the peg hole 844. A junction of the top side 84 and the vertical side 85 defines a through hole 847. The retaining potions 87 respectively define a plurality of L-shaped fixing slots 872, configured for fixing a server to the locking member 80.

The blocking member 90 includes a blocking part 92, a sliding post 95, and a peg 96. The blocking part 92 is polygon-shaped, and defines a pivot hole 922 and a fixing hole 924 therein. The blocking part 92 further defines a blocking surface 925 adjacent the fixing hole 924. A resilient portion 93 extends from a side surface of the blocking part 92.

Referring also to FIGS. 2, 3, 7 and 8, to assemble the locking subassembly 100, the interlocking member 70 is slidably engaged between the locking portion 83 and the body 82 of the locking member 80. The interlocking member grip 72 is received in the depressed portion of the locking member grip 81, and abuts against a first end adjacent the locking portion 83 of the locking member grip 81. The driving portion 752 and the slanting slot 742 of the interlocking member 70 respectively align with the through hole 847 and the arc-shaped slot 846 of the locking member 80. The second elastic member 42 is received in the receiving hole 712 of the interlocking member body 71. Two ends of the second elastic member 42 respectively hook the hook hole 714 of the interlocking member body 71 and the hook hole 822 of the interlocking member body 82. The blocking part 92 of the blocking member 90 is placed on the top side 84 of the locking member 80. The sliding post 95 is fixed in the fixing hole 924 of the blocking part 92. A lower end of the sliding post 95 is slidably received in the arc-shaped slot 846 of the locking portion 83 of the locking member 80 and the slanting slot 742 of the interlocking portion 73 of the interlocking member 70, and is located at first ends of the arc-shaped slot 846 and the slanting slot 742 that are adjacent the vertical side 85 of the locking portion 83 of the locking member 80. The peg 96 rotatably passes through the pivot hole 922 of the blocking part 92, and engages in the peg hole 844 of the locking portion 83 of the locking member 80. A free end of the resilient portion 93 of the blocking part 92 resists against the protrusion 842 of the locking portion 83 of the locking member 80 (see FIG. 10).

A plurality of screws passes through the fixing holes 862 of the supporting portion 86 of the locking member 80 and screws into the screw holes of the inner rail 54 to secure the inner rail 50 to the locking subassembly 100. A plurality of screws passes through the fixing holes 622 of the fixing portion 62 of the retaining member 60 and screws into the screw holes of the outer rail 52 of the sliding rail 50 to secure the outer rail 52 to the locking subassembly 100. The retaining portion 64 covers the locking portion 83 of the locking member 80. The supporting tab 684 of the retaining portion 64 slidably abuts against the bottom side 76 of the interlocking portion 73 of the interlocking member 70. The blocking surface 925 of the blocking part 92 is blocked by an end of the blocking tab 682 of the retaining member 60, thus the locking member 80 cannot slide relative to the retaining member 60, and the inner rail 54 of the sliding rail 50 cannot slide relative to the outer rail 52; correspondingly, a server fixed to the retaining portion 87 of the locking member 80 cannot move. Here, the first hole 652 of the retaining member 60, the driving portion 752 of the interlocking member 70, and the through hole 847 of the locking member 80 are in alignment. The second hole 662 of the retaining member 60 and the retaining opening 762 of the interlocking member 70 are in alignment as well.

Figure 9:
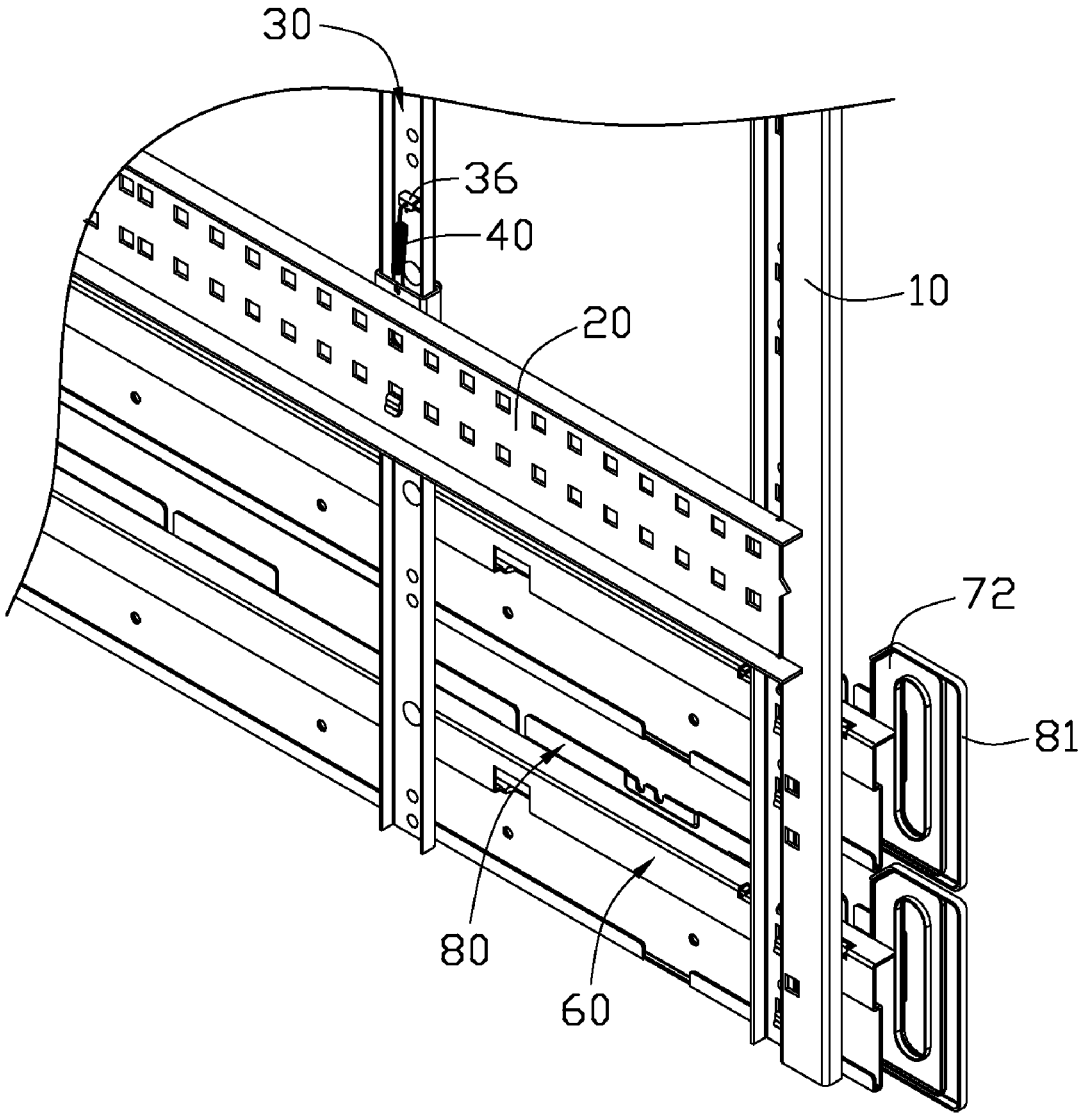
FIG. 9 is an assembled, isometric view of FIG. 1, but viewed from another aspect.
Figure 10:
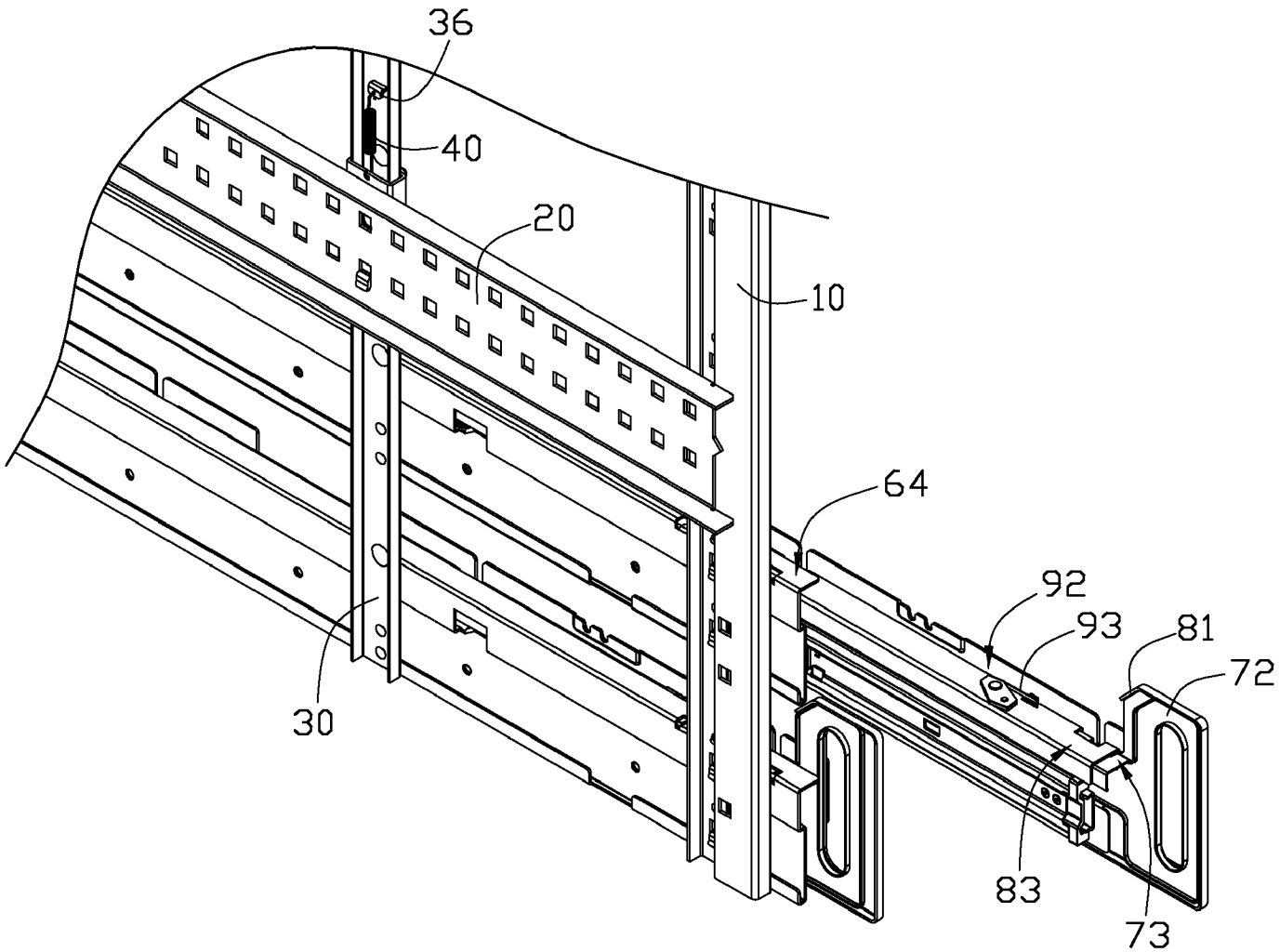
FIG. 10 is similar to FIG. 9, but shows a using state.
Figure 11:
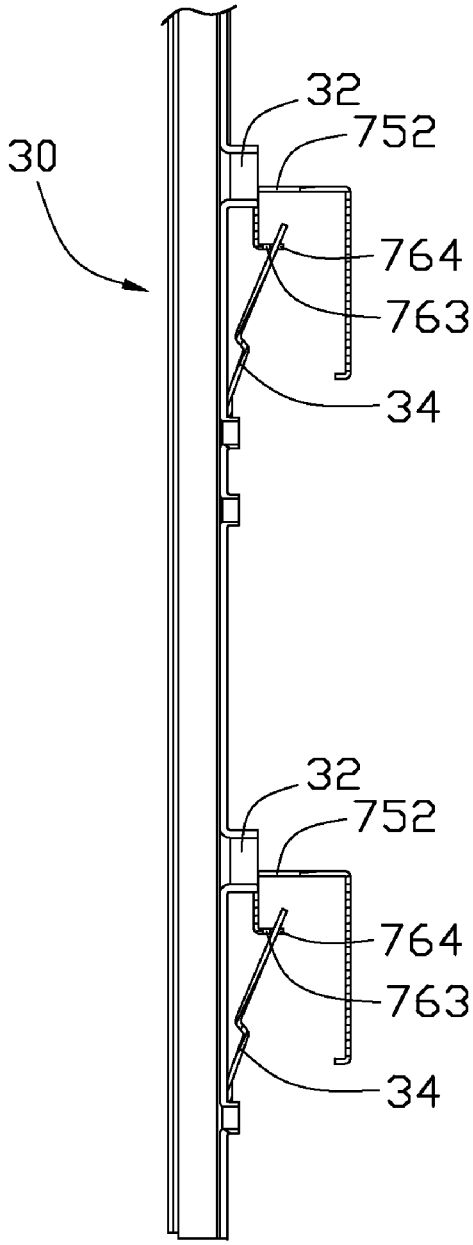
FIGS. 11 and 12 respectively show position relations of the rod and two interlocking members of FIG. 9 and FIG. 10.
Figure 12:
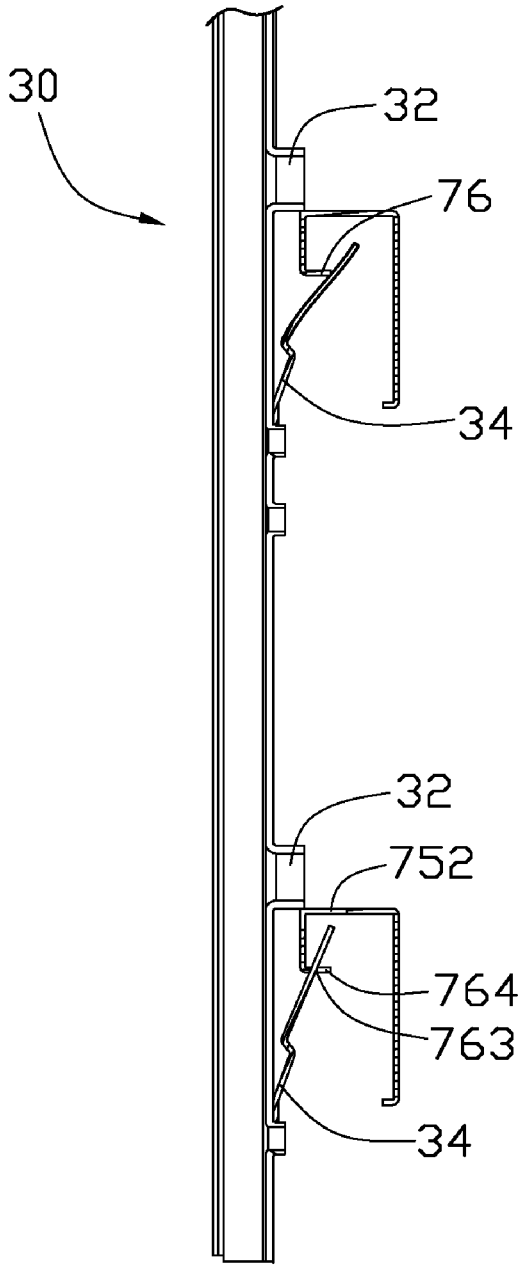

Referring also to FIGS. 1, 9 and 11, the rod 30 slidably passes through the receiving portion 22 of the beam 20. Two ends of the first elastic member 40 respectively hook the hook portion 36 of the rod 30 and the hook hole 221 of the receiving portion 22. A plurality of fixing means (such as screws fixes the retaining member 60 of each locking subassembly 100 to the columns 10 parallel to the beam 20. A corresponding protrusion 32 of the rod 30 extends through the first hole 652 of the retaining member 60, the through hole 847 of the locking member 80, and the receiving part 753 of the driving portion 752 of the interlocking member 70; and is blocked by the driving portion guiding part 754. A corresponding resilient member 34 of the rod 30 extends through the second hole 662 of the retaining member 60 and the retaining opening guiding part 764 of the interlocking member 70 (see FIG. 11).

Referring also to FIGS. 9 to 12, when one of the servers is pulled out, the action causes the corresponding interlocking member grip 72 to abut against a second end away from the locking portion 83 of the locking member grip 81. The second elastic member 42 is deformed. In this course, the interlocking member 70 slides relative to the locking member 80; an edge of the slanting slot 742 of the locking member 70 pushes the sliding post 95 of the blocking member 90 to move to second ends of the slanting slot 742 and the arc-shaped slot 846 of the locking member 80 that are opposite to their first ends; the blocking part 92 rotates around the peg 96, and the resilient portion 93 deforms. An edge of the driving portion guiding part 754 of the interlocking member 70 pushes the corresponding protrusion 32 of the rod 30 to slide out of the driving portion 752 and move onto the interlocking member top side 74. The corresponding resilient member 34 of the rod 30 moves upwards along the retaining opening guiding part 764, and is deformed by an edge of the retaining opening guiding part 764. The corresponding resilient member 34 slides along the edge of the retaining opening guiding part 764 to an edge of the interlocking member bottom side 76. The first elastic member 40 is deformed. The blocking surface 925 of the blocking part 92 moves away from the blocking tab 682 of the retaining member 60, such that the locking member 80, the server fixed at the locking member 80, the interlocking member 70, and the inner rail 54 can slide relative to the cabinet, the retaining member 60, and the outer rail 52.

Because the resilient members 34 are angled away from the rod 30, the resilient members 34 corresponding to the other servers move to the retaining parts 763 of the retaining openings 762 of the interlocking members 70 of the corresponding locking subassemblies 100. The servers fixed at these locking subassemblies 100 cannot be pulled out of the cabinet.

When the server is pushed back into the cabinet, the interlocking member 70 slides to its original position via the restoration of the second elastic member 42. The sliding post 95 of the blocking member 90 is pushed by the edge of the slanting slot 742 of the interlocking member 70 to slide to the first ends of the slanting slot 742 and the arc-shaped slot 846 of the locking member 80. The resilient portion 93 restores to help the blocking part 92 of the blocking member 90 to rotate, and the blocking surface 925 of the blocking part 92 is blocked by the blocking tab 682 of the retaining member 60. The rod 30 slides to its original position via the restoration of the first elastic member 40. Then any one of the servers can be pulled out of the cabinet by operating the interlocking member 70 of the corresponding locking subassemblies 100.

In other embodiments, the locking members 80 and the blocking members 90 can be omitted, and the interlocking members 70 are directly fixed to the inner rails 54 of the corresponding sliding rails 50. The inner rails 54 define a plurality of fixing slots to fix servers. The present invention will achieve a similar effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An interlocking mechanism, comprising:

a plurality of sliding rails mounted to a cabinet, each sliding rail comprising an outer rail and an inner rail slidably attached to the outer rail;

a plurality of interlocking members capable of moving from a first position to a second position, each interlocking member defining a driving portion and a retaining opening, wherein the retaining opening comprises a guiding part and a retaining part; the interlocking members are respectively attached to the sliding rails; and a rod resiliently and slidably attached to the cabinet, wherein the rod is capable of moving from a third position to a forth position; and the rod comprises a plurality of protrusions and a plurality of corresponding resilient members, each resilient member is angled away from the rod such that the angle is open toward the direction the rod slides and corresponding to each of the interlocking members;

on the condition that one of the interlocking members moves from the first position to the second position, the driving portion of the interlocking member is capable of pushing the corresponding protrusion to drive the rod to move to the forth position, the retaining opening guiding part of the interlocking member is capable of deforming the corresponding resilient member, the other resilient members are capable of moving to the retaining opening retaining parts to lock the other interlocking members to prevent the corresponding sliding rails from sliding;

wherein each of the resilient members comprises a first end and a second end, the first end is fixed to the rod, the second end is a free end, and each of the protrusions extends from the rod adjacent the free end of a corresponding one of the resilient members.

2. The interlocking mechanism as claimed in claim 1, wherein the driving portion of the interlocking member is a trapezoid-shaped opening.

3. The interlocking mechanism as claimed in claim 1, wherein the retaining opening guiding part of the interlocking member is trapezoid-shaped, and the retaining opening retaining part is rectangle-shaped.

4. The interlocking mechanism as claimed in claim 1 further comprising a first elastic member, wherein two ends of the first elastic member hook the cabinet and the rod respectively to bias the rod moving from the forth position to the third position.

5. The interlocking mechanism as claimed in claim 1, wherein the interlocking members are fixed to the corresponding inner rails of the sliding rails.

6. The interlocking mechanism as claimed in claim 1, wherein each of the plurality of interlocking members further comprises an interlocking portion; the interlocking portion comprises a top side, a bottom side, and a vertical side connecting the top side and the bottom side; the driving portion is defined in the vertical side; and the retaining opening is defined at the bottom side.

7. The interlocking mechanism as claimed in claim 6 further comprising a plurality of retaining members corresponding to the plurality of sliding rails, wherein the outer rail of each the sliding rail is fixed to the corresponding retaining member, each retaining member defines a blocking tab protruding therefrom.

8. The interlocking mechanism as claimed in claim 7, wherein each of the plurality of retaining members comprises a supporting tab abutting against the bottom side of the corresponding interlocking member.

9. The interlocking mechanism as claimed in claim 8 further comprising a plurality of locking members and corresponding blocking members, corresponding to the plurality of sliding rails, and a plurality of corresponding second elastic members, wherein each blocking member is attached to the corresponding locking member and capable of blocking the blocking tab the corresponding retaining member to prevent the corresponding sliding rail from sliding; the inner rail of the sliding rail is fixed at the locking member; the interlocking member is slidably engaged between the inner rail and the locking member, and capable of separating the blocking member from the blocking tab on the condition that the interlocking member moves to the second position; and two ends of the second elastic member hook the interlocking member and the locking member to bias the interlocking member moving from the second position to the first position.

10. The interlocking mechanism as claimed in claim 9, wherein each of the plurality of blocking members comprises a blocking part capable of being blocked by the blocking tab, and a peg rotatably passing through a pivot hole defined in the blocking part to engage in a peg hole defined in the locking member.

11. The interlocking mechanism as claimed in claim 10, wherein each of the plurality of blocking members further comprises a sliding post engaged in a fixing hole defined in the blocking part; each of the plurality of locking members defines an arc-shaped slot having a same center point as the peg hole thereof, and each of the plurality of interlocking member defines a slanting slot correspondingly; an end of the sliding post is slidably received in the corresponding interlocking member's slanting slot and the locking member's arc-shaped slot, and locates at first ends of the slanting slot and the arc-shaped slot; and on the condition that the interlocking member slides, an edge of the slanting slot is capable of pushing the sliding post to move to second ends of the slanting slot and the arc-shaped slot to drive the blocking part to rotate, such that the blocking part is capable of being divorced from the retaining member blocking tab.

12. An assembly, comprising:

a cabinet comprising two parallel columns and a beam perpendicularly attached to the columns;

at least two interlocking members capable of moving from a first position to a second position, each comprising a driving portion and a retaining opening;

a rod resiliently and slidably attached to the beam, wherein the rod is capable of moving from a third position to a forth position; the rod comprises at least two protrusions and at least two resilient members slantingly attached adjacent the protrusions respectively and corresponding to the at least two interlocking members; and at least two sliding rails attached to the columns, each sliding rail comprising an outer rail and an inner rail slidably attached to the outer rail;

wherein the interlocking members are respectively attached to the inner rails of the sliding rails; each retaining opening comprises a guiding part and a retaining part;

on the condition that one of the interlocking members moves from the first position to the second position, the driving portion of the interlocking member engagingly pushes the corresponding protrusion to drive the rod to move to the forth position, the retaining opening guiding part of the interlocking member deforms the corresponding resilient member, the rest of the at least two resilient members correspondingly move to the retaining opening retaining parts of the rest of the interlocking members to lock the rest of the at least two interlocking members and prevent the corresponding sliding rails from sliding.

13. The assembly as claimed in claim 12, wherein each of the interlocking members further comprises an interlocking portion; the interlocking portion comprises a top side, a bottom side, and a vertical side connecting the top side and the bottom side; the driving portion is defined in the vertical side; and the retaining opening is defined at the bottom side.

14. The assembly as claimed in claim 12 further comprising at least two retaining members corresponding to the sliding rails, wherein the outer rail of each the sliding rail is fixed to the corresponding retaining member, and each retaining member defines a blocking tab protruding therefrom.

15. The assembly as claimed in claim 14, wherein each of the retaining members comprises a supporting tab abutting against the corresponding interlocking member.

16. The assembly as claimed in claim 15 further comprising at least two locking members and corresponding blocking members, corresponding to the at least two sliding rails, and at least two corresponding second elastic members, wherein each blocking member is attached to the corresponding locking member and capable of blocking the blocking tab of the corresponding retaining member to prevent the corresponding sliding rail from sliding; the inner rails of the sliding rails are correspondingly fixed to the locking member; the interlocking member is slidably engaged between the inner rail and the locking member, and capable of disengaging the blocking member from the blocking tab on the condition that the interlocking member moves to the second position; and opposite ends of each of the second elastic members are respectively engaged with corresponding one interlocking members and one locking member to bias the interlocking member moving from the second position to the first position.

17. The assembly as claimed in claim 16, wherein each of the blocking members comprises a blocking part to be blocked by the blocking tab, and a peg rotatably passing through a pivot hole defined in the blocking part and secured in a peg hole defined in the locking member.

* * * * *